United States Patent [19]

Kamprath et al.

[11] Patent Number: 4,930,469

[45] Date of Patent: Jun. 5, 1990

[54] OIL PAN FOR AN INTERNAL COMBUSTION ENGINE

[75] Inventors: Axel Kamprath, Endingen; Johannes Weyandt, Illingen, both of Fed. Rep. of Germany

[73] Assignee: Dr. Ing. h.c.F. Porsche AG, Fed. Rep. of Germany

[21] Appl. No.: 405,197

[22] Filed: Sep. 11, 1989

[30] Foreign Application Priority Data

Sep. 12, 1988 [DE] Fed. Rep. of Germany ..... 3830966

[51] Int. Cl.[5] ..... F01M 1/12

[52] U.S. Cl. ..... 123/195 C; 220/327

[58] Field of Search ..... 123/195 C, 196 R, 198 E; 184/1.5, 6.5, 106; 220/327

[56] References Cited

U.S. PATENT DOCUMENTS 4,296,716 10/1981 Hofbauer et al. ..... 123/195 C
4,449,493 5/1984 Kopec et al. ..... 123/198 E

FOREIGN PATENT DOCUMENTS 1041295 10/1958 Fed. Rep. of Germany .
3606052 7/1986 Fed. Rep. of Germany .
3830966 5/1989 Fed. Rep. of Germany .
158306 9/1984 Japan ..... 184/106

*Primary Examiner*—Noah P. Kamen
*Attorney, Agent, or Firm*—Evenson, Wands, Edwards, Lenahan and McKeown

[57] ABSTRACT

An oil pan, which is made of plastic, has a baffle pot insert on a bottom thereof which is formed by a one piece pot-shaped plastic component. This baffle pot insert extends from the exterior side of the bottom into the oil pan. Further, a collar of the baffle pot insert rests against a bottom section of the oil pan. Screws, which penetrate the collar and are turned into threaded metal inserts of the oil pan, are used for fastening the baffle pot insert to the oil pan.

10 Claims, 1 Drawing Sheet

A
B
X
1
2
3
4
5
6
7
8
9
10
11
12
13
14
15
16
17
18
19
20
21
22
23
24
25
26
27
28
29
30
31
32
33

OIL PAN FOR AN INTERNAL COMBUSTION ENGINE

BACKGROUND AND SUMMARY OF THE INVENTION

The present invention relates to an oil pan, and more particularly, to a baffle pot insert for an oil pan constructed to permit easy mounting of a device, which is connected to an internal combustion engine, to the oil pan.

German Published Examined Patent Application (DE-AS) 1 041 295 discloses an arrangement for holding a baffle pot insert, by means of spring elements, to lugs of an oil pan. The multi-part and therefore expensive baffle pot insert can be introduced into the oil pan bottom by way of an opening which is closed off by a plate fastened by screws It is a disadvantage in this case that the spring elements are expensive components and, because of the occurring internal combustion engine vibrations, must be adapted relatively precisely to the lugs with respect to tolerances, which is expensive. Additional fastening measures for the plate are also required In addition, a plastic oil pan is disclosed by German Published Unexamined Patent Application (DE-OS) 36 06 052 which indicates no measure for receiving a baffle pot insert.

Accordingly, it is an object of the present invention to simplify a baffle pot insert for an oil pan and to construct the baffle pot in such a manner that a device for feeding the oil pump, which is connected with the internal combustion engine, can be mounted easily.

Principal advantages achieved by the invention are that the baffle pot insert is a simple, easily manufacturable component which can be fastened to the oil pan without any problems. In addition, the baffle pot insert can be mounted when the oil pan is already fastened to a crankcase, out of which a device consisting of a pipe piece and a sieve for the feeding of the oil is guided into the oil pan If, in the case of this mounting arrangement, the baffle pot insert were a fixed component of the oil pan, the introduction of the device into the insert would cause complicated and time consuming mounting operations.

Also, the baffle pot insert is integrated into the oil pan such that, on a side facing away from the interior of the oil pan, the insert does not project beyond the bottom of the oil pan. Additionally, a collar, bottom section, screws and seal ensure a fastening of the baffle pot insert at the oil pan which is appropriate for its functioning.

Other objects, advantages and novel features of the present invention will become apparent from the following detailed description of the invention when considered in conjunction with the accompanying drawings.

DETAILED DESCRIPTION OF THE DRAWINGS

Figures 1, 2:
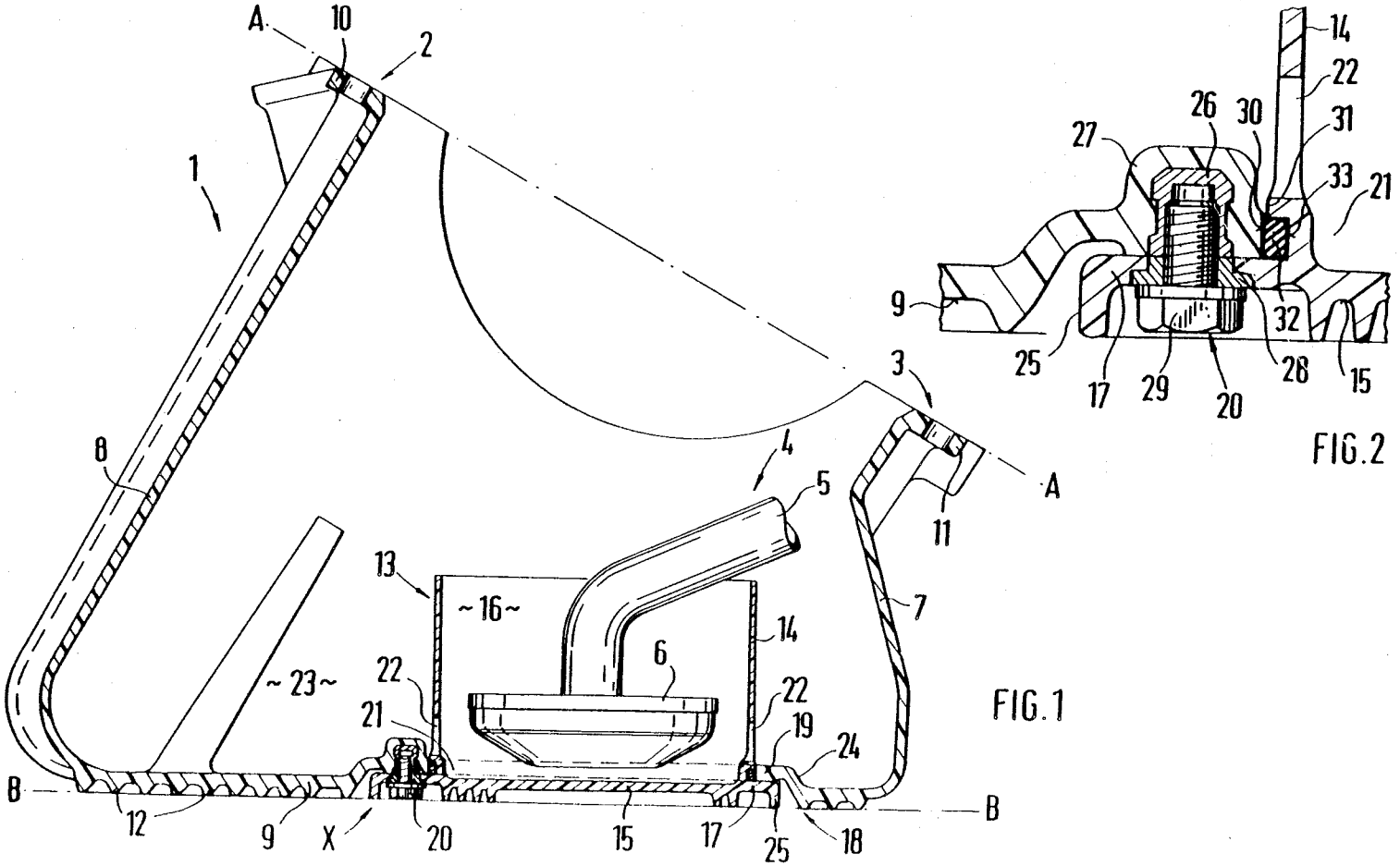
FIG. 1 is a cross-sectional view of an oil pan for an internal combustion engine in accordance with one embodiment of the present invention.
FIG. 2 is an enlarged view of a detail X of FIG. 1.

In the area of a junction plane A—A, an oil pan 1 is connected to a crankcase of an internal combustion engine which is not shown. Screws, which act at 2 and

3, are used for connecting the oil pan 1 with the crankcase. The internal combustion engine includes a device 4, which is used for feeding the oil pump and has a pipe piece 5 and a sieve 6; the sieve 6 being arranged at a free end of the pipe piece 5.

The oil pan 1, which is made, for example, of plastic, is formed by relatively upright lateral walls 7, 8 and a bottom 9. Flanges 10, 11 are provided at free ends of the walls 7, 8. The bottom 9 is aligned approximately horizontally and, at the exterior side, is provided with several ribs 12.

At the bottom 9, a pot shaped baffle pot insert 13 is provided which is made of one piece, out of, for example, a plastic material, and comprises a circumferential wall 14 extending substantially vertically with respect to the bottom 9, and a bottom part 15.

On a side facing away from the bottom part 15, the baffle pot insert 13 is open. The pipe part 5 with the sieve 6, which extends close to the bottom part 15, extends in sections, into an interior 16 of the baffle pot insert 13

The bottom part 15 extends beyond the circular circumferential wall 14, creating a collar 17 which extends parallel to the bottom 9 and rests against an exterior side 18 thereof. For this purpose, the bottom 9 has a bottom section 19, at which the collar 17 is held by means of screws 20. With an opening 21, the bottom section 19 delimits the circumferential wall 14 which is provided with several inflow openings 22

The bottom section 19 is arranged in such a way at a ridge 24 directed toward the oil pan interior 23 that the collar 17 is sunk with the bottom section 19 and extends within a limiting plane B—B of the bottom 9, a bend 25 at a free end of the collar 17 also not projecting beyond the plane B—B.

According to FIG. 2, the screws 20 are threaded into a threaded metal insert 26 which is surrounded by a plastic enlargement 27 and extends to the collar 17 In the collar 17, and specifically in the area of the screws 20, a metal insert 28 is provided which, open one side, supports itself at the threaded metal insert 26 and, on the other side, is used for the support of a head 29 of the screw 20.

The opening 21 of the bottom section 19 has a boundary which is constructed as a sealing surface 30 and extends to an exterior side 31 of the circumferential wall 14. A sealing body 32 is arranged between the sealing surface 30 and the circumferential wall 14, this sealing body 32 resting in a U-shaped recess 33 of the circumferential wall 14.

Although the present invention has been described and illustrated in detail, it is to be clearly understood that the same is by way of illustration and example only, and is not to be taken by way of limitation The spirit and scope of the present invention are to be limited only by the terms of the appended claims.

What is claimed:

1. An oil pan for an internal combustion engine having walls and a bottom and which is held at a crankcase of an internal combustion engine by screw means, a baffle pot insert being provided adjacent to the bottom, a suction sieve of a device for an oil pump supply of the internal combustion engine resting in the baffle pot insert, wherein the baffle pot insert is a one piece plastic component which is manufactured separately from the oil pan and has a collar extending parallel to the bottom which rests against an exterior side of the bottom, and wherein the collar is held by baffle pot insert screw means, at a bottom section of the bottom, the bottom section having an opening for receiving the baffle pot.

2. An oil pan according to claim 1, wherein the collar, at a free end thereof, is provided with a bend.

3. An oil pan according to claim 1, wherein the bottom section is arranged at a ridge directed into an oil pan interior.

4. An oil pan according to claim 1, wherein the baffle pot insert screw means are threaded into threaded metal, bottom section inserts which are arranged in local enlargements of the bottom section.

5. An oil pan according to claim 4, wherein heads of the baffle plate insert screw means rest against metal, collar inserts of the collar which, on sides facing away from the heads, are supported on the threaded metal, bottom section inserts.

6. An oil pan according to claim 4, wherein the opening has a boundary constructed as a sealing surface which extends to an exterior side of a circumferential wall of the baffle pot insert, a sealing body being provided between the sealing surface and the circumferential wall.

7. An oil pan according to claim 6, wherein the sealing body is provided in a recess of the circumferential wall.

8. An oil pan according to claim 1, wherein heads of the baffle plate insert screw means rest against metal, collar inserts of the collar which, on sides facing away from the heads, are supported on threaded metal, bottom section inserts.

9. An oil pan according to claim 1, wherein the opening has a boundary constructed as a sealing surface which extends to an exterior side of a circumferential wall of the baffle pot insert, a sealing body being provided between the sealing surface and the circumferential wall.

10. An oil pan according to claim 9, wherein the sealing body is provided in a recess of the circumferential wall.

* * * * *